US008234760B2

(12) United States Patent
Vogelsang et al.

(10) Patent No.: US 8,234,760 B2
(45) Date of Patent: Aug. 7, 2012

(54) MECHANICAL ZIPPER ASSIST

(75) Inventors: Glenn D. Vogelsang, Paris, TX (US); Thomas J. Broeski, Afton, VA (US)

(73) Assignee: Dr. V's Life Plan, Inc., Paris, TX (US)

( * ) Notice: Subject to any disclaimer, the term of this patent is extended or adjusted under 35 U.S.C. 154(b) by 296 days.

(21) Appl. No.: 12/754,661

(22) Filed: Apr. 6, 2010

(65) Prior Publication Data

US 2010/0192333 A1 Aug. 5, 2010

Related U.S. Application Data

(63) Continuation-in-part of application No. 12/325,037, filed on Nov. 28, 2008, now abandoned.

(60) Provisional application No. 60/990,707, filed on Nov. 28, 2007.

(51) Int. Cl.
*A44B 19/26* (2006.01)

(52) U.S. Cl. ..... 24/387; 24/429

(58) Field of Classification Search ..... 24/381, 24/386, 429, 387, 390; 294/3.6
See application file for complete search history.

(56) References Cited

U.S. PATENT DOCUMENTS

| | | | | |
|---|---|---|---|---|
| 2,224,930 | A | 12/1940 | Roseman | |
| 3,125,791 | A | 3/1964 | Downs | |
| 3,255,503 | A * | 6/1966 | Sozzi | 24/387 |
| 2004/0055118 | A1 | 3/2004 | Marty et al. | |
| 2008/0209694 | A1 | 9/2008 | Horikawa et al. | |

* cited by examiner

*Primary Examiner* — James Brittain
(74) *Attorney, Agent, or Firm* — McNees Wallace & Nurick LLC

(57) ABSTRACT

A zipper closure system for allowing one hand zipping of objects requiring sufficient compressive force to close is provided. The zipper closure system comprises a set of tracks having a row of teeth adapted to mate with each other, a plurality of sliders that are adapted to move along the row of teeth, a connector system comprising a plurality of extenders attached to the pull tabs that allow a user to move the plurality of sliders along the row of teeth, and a connector attached to a third pull tab, where the connector links the third slider with the first and second sliders. The zipper system further includes at least one pull ring and a stopping member.

11 Claims, 13 Drawing Sheets

MECHANICAL ZIPPER ASSIST

CROSS-REFERENCE TO RELATED APPLICATIONS

This patent application is a continuation-in-part of U.S. patent application Ser. No. 12/325,037 filed on Nov. 28, 2008, and entitled "Mechanical Zipper Assist," which claims the benefit of U.S. Provisional Patent Application Ser. No. 60/990,707 filed on Nov. 28, 2007 and entitled "Dr. V's Hose Helper," now abandoned, the disclosures of which are incorporated by reference herein in their entirety and made part of the present U.S. utility patent application for all purposes.

BACKGROUND OF THE INVENTION

The described invention relates generally to closure systems for use with garments and the like, and more specifically to a zipper system that includes a plurality of zippers which have been modified to allow a user to easily close the zipper on a garment by using only one hand.

Countless devices contain fasteners, of which one popular type is a zipper. A typical zipper includes a track or chain having two rows of teeth that interlock or mate with each other. A zipper slider is located on the track so that a user can pull on a pull tab on the zipper slider in order to move the slider up and down the track, thereby causing the teeth to open and close to form a chain as desired. A drawback in the current zipper systems is that if any pressure or tension is needed to close the zipper a person must use two hands or have assistance from another person to obtain adequate compressive force to close the zipper.

Therefore, while various devices are known in the art for fastening or closing together cloth or garments, a need still exists in the art for a zipper system that is easy to use, especially with only one hand.

SUMMARY OF THE INVENTION

The following provides a summary of exemplary embodiments of zipper system according to the present invention. This summary is not an extensive overview and is not intended to identify key or critical aspects or elements of the present invention or to delineate its scope. This invention provides a solution for consumers that need to close garments, specifically garments and such that require sufficient compressive pressure to adequately close the gap in those garments, such as compression stockings, wetsuits, and other garments that have elastic properties. The present invention allows a user to easily zip up or close a zipper with only one hand on garments or the like that require sufficient inward compressive pressure to enable mating of the two rows of teeth to provide closure to the zipper system.

In accordance with one aspect of the present invention, a zipper closure system is provided. This zipper closure system comprises a first track and a second track, each track further including a row of teeth, wherein the teeth of the first track are adapted to mate with the teeth of the second track; a first slider adapted to move along the first track, wherein the first slider further includes a first pull tab connected thereto and a first pull tab extender connected to the first pull tab, wherein the first pull tab extender further includes a linking portion and a ring portion; a second slider adapted to move along the second track, wherein the second slider further includes a second pull tab connected thereto and a second pull tab extender connected to the second pull tab, wherein the second pull tab extender further includes a linking portion and a ring portion; a third slider, positioned between the first and second sliders, wherein the third slider is operative to mate the first track with the second track; and a connector, wherein the connector is operative to link the third slider with the first and second sliders.

In accordance with one aspect of the present invention, a zipper system is provided. This zipper system is intended for use with one hand and includes a set of tracks having a row of fasteners mate-able with each other, a plurality of sliders that cooperate with the row of fasteners, a connector system for joining the plurality of sliders and allowing the user to move the plurality of sliders along the row of fasteners, and a stopper. The plurality of sliders are adapted to cooperate with the row of fasteners of the first and the second tracks, and the plurality of sliders further comprises a first slider that is adapted to slide along the first track, a second slider that is adapted to slide along the second track, and a third slider, central to the first and second sliders, that cooperates with both the first and second tracks to cause first and second track to mate to form a closed chain. The connector system further comprises a plurality of extenders, and a pull ring. The plurality of extenders further comprise a first extender attached to a first pull tab of the first slider, a second extender attached to a second pull tab of the second slider, and a third extender central to the first and second extenders and attached to a third pull tab of the third slider. The pull ring is attached to the first extender, the second extender and the third extender. The stopper holds the plurality of sliders in place once the sliders have reached a predetermined position on the track and the full chain has been formed.

In accordance with another aspect of the present invention, a one hand zipper system is provided. This zipping system includes a set of tracks having a row of fasteners mate-able with each other, a plurality of sliders that cooperate with the row of fasteners, a connector system for joining the plurality of sliders and allowing the user to move the plurality of sliders along the row of fasteners, and a stopper. The plurality of sliders are adapted to cooperate with the row of fasteners of the first and the second tracks, and the plurality of sliders further comprises a first slider that is adapted to slide along the first track, a second slider that is adapted to slide along the second track, and a third slider, central to the first and second sliders, that cooperates with both the first and second tracks to cause first and second track to mate to form a closed chain. The connector system further comprises a plurality of extenders, a bundler, and a plurality of pull rings. The plurality of extenders further comprises a first extender attached to a first pull tab of the first slider, a second extender attached to a second pull tab of the second slider, and a third extender attached to a third pull tab of the third slider. The bundler bundles the first extender, the second extender, and third extender. The plurality of pull rings allows for easy movement along the row of fasteners of both tracks to form the chain, and the plurality of pull rings further comprises a first pull ring attached to the first extender and bundled by the bundler, a second pull ring attached to the second extender and bundled by the bundler, and a third pull ring attached to the third extender and bundled by the bundler. The stopper holds the plurality of sliders in place once the sliders have reached a predetermined position on the track and the full chain has been formed.

In yet another aspect of this invention, a zipper system is provided. This zipping system includes a set of tracks having a row of fasteners mate-able with each other, a plurality of sliders that cooperate with the row of fasteners, a connector system for joining the plurality of sliders and allowing the user to move the plurality of sliders along the row of fasteners, and a brake system. The plurality of sliders is adapted to cooperate with the row of fasteners of the first and the second tracks, and the plurality of sliders further comprises a first slider adapted to slide along the first track, a second slider adapted to slide along the second track, and a third slider, central to the first and second sliders, that cooperates with both the first and second tracks to cause first and second track to mate to form a closed chain. The connector system further comprises a plurality of extenders and a pull ring. The plurality of extenders further comprises a first extender attached to a first pull tab of the first slider, and the first extender is further attached to a first connector piece, and the first connector piece is further attached to a third connector piece, a second extender attached to a second pull tab of the second slider, and the second extender is further attached to a second connector piece, and the second connector piece is further attached to the third connector piece, and a third extender attached to a third pull tab of the third slider, wherein the third extender is further attached to the third connector piece. The pull ring is attached to the third connector piece to allow easy movement along the row of fasteners of both tracks to form the closed chain. The brake system holds the plurality of sliders in place once the sliders have reached a predetermined position on the track and the full chain has been formed.

In yet another aspect of this invention, a zipper system adapted for use with one hand is provided. The zipper system includes a first track and a second track, a plurality of sliders, a connector system, and a connector attached to a third pull tab of the third slider. The first and second tracks of the zipper system further include a row of teeth, where the teeth of the first track are adapted to mate with the teeth of the second track. The plurality of sliders are adapted to cooperate with the row of teeth of the first and the second tracks, and further include a first slider, a second slider and a third slider. The first slider that is adapted to slide along the first track and the second slider that is adapted to slide along the second track. The third slider, central to the first and second sliders, cooperates with both the first and second tracks to cause the first track and the second track to mate to form a chain. The connector system further includes a plurality of extenders, wherein the plurality of extenders further includes a first extender pivotally attached to a first pull tab of the first slider, and a second extender pivotally attached to a second pull tab of the second slider, and a joining device adapted to pivotally connect the first extender with the second extender, wherein the joining device further includes a ring portion. The connector is attached to a third pull tab of the third slider, wherein the connector is operative to link the third slider with the first and second sliders.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
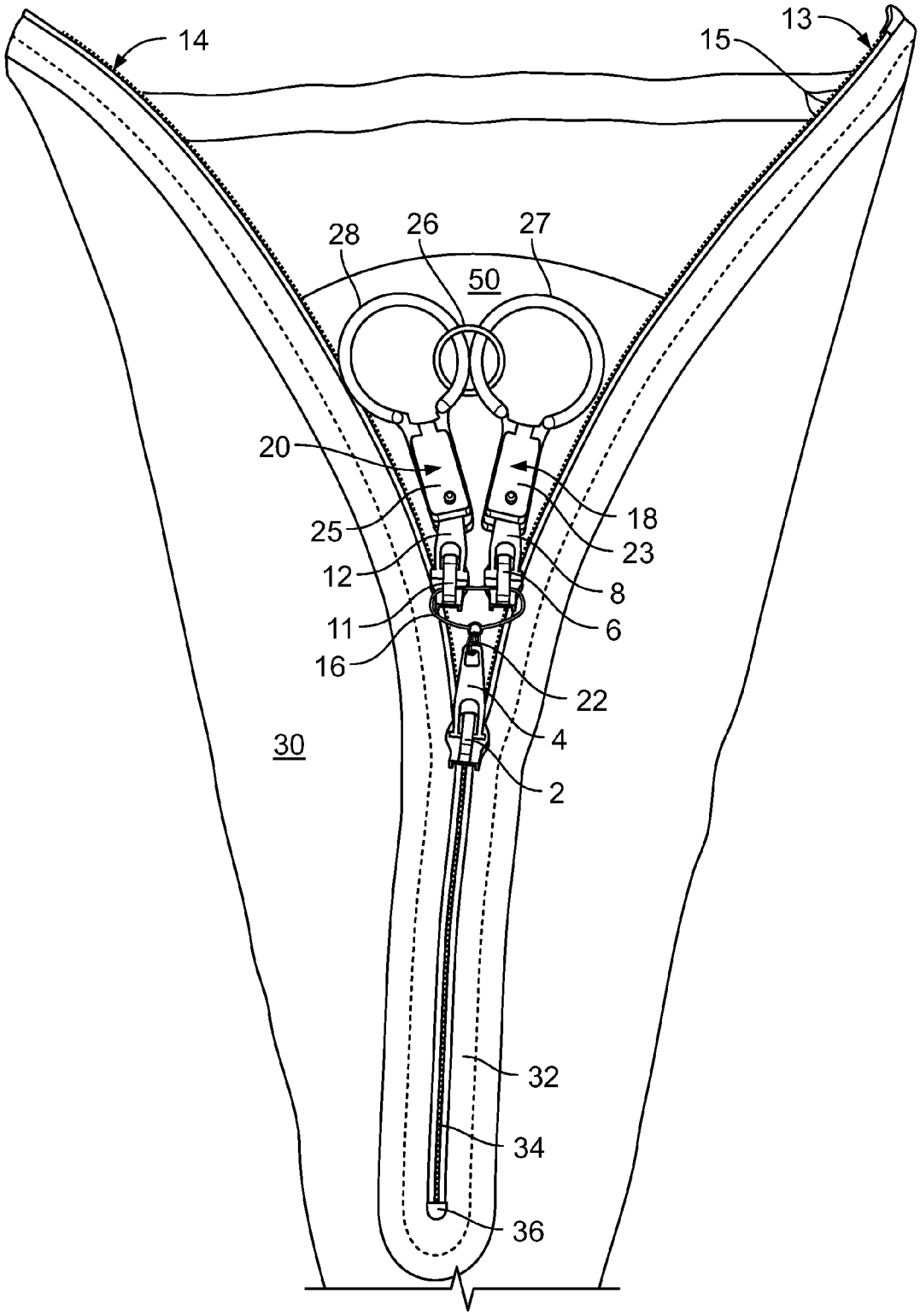
FIG. 1 is a front view of a first exemplary embodiment of the zipper closure system of the present invention.

Exemplary embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to a zipper system. As previously indicated, a first general embodiment of this invention provides zipper closure system; a second general embodiment provides a zipper system for use with one hand; a third general embodiment provides a zipper system for use with one hand having a bundling means; and a fourth general embodiment of this invention provides a zipper system for use with hand having a brake and/or release mechanism. With reference now to the Figures, one or more specific embodiments of this invention shall be described in greater detail.

FIG. 1 illustrates a first exemplary embodiment of zipper system 10. Zipper system 10 includes first track 13 and second track 14, wherein each track comprises a row of fasteners or teeth 15 that are adapted to mate or that are mate-able with each other to form a closed chain 34. Fasteners/teeth 15 of zipper system 10 can be made of any type of material commonly used to make zippers, such as metal, plastic, nylon and combinations thereof. Zipper system 10 further comprises a plurality of sliders: first slider 6, second slider 11, and third slider 2, that are adapted to move along the tracks of zipper system 10. First slider 6 further includes a first pull tab 8 connected thereto. First pull tab 8 is further connected to a first pull tab extender 18. First pull tab extender 18 further includes a linking portion 23 and ring portion 27. Second slider 11 further includes a second pull tab 12 connected thereto. Second pull tab 12 is further connected to a second pull tab extender 20. Second pull tab extender 20 further includes a linking portion 25 and a ring portion 28. First slider 6 is adapted to move or slide over teeth 15 of first track 13 and second slider 11 is adapted to move or slide over teeth 15 of second track 14 to provide adequate compressive force for zipper system 10 to close. Third slider 2, located between first and second sliders 6 and 11, further includes a pull tab 4 and can optionally include a joining ring 22. Third slider 2 cooperates and moves or slides along teeth 15 of both first track 13 and second track 14 and causes teeth 15 of both tracks 13 and 14 to mate to form closed chain 34. Zipper system 10 further comprises a connector 16 that joins the plurality of sliders 2, 6, and 11 to allow a user to advance the plurality of sliders along teeth 15 of tracks 13, 14 using only one hand. As shown in FIG. 1, connector 16 operates to link third slider 2 with first and second sliders 6 and 11.

Pull tab extenders 18 and 20 can be made from any material that will allow upward force to be applied by the user. Pull tab extenders can be made from any suitable durable material known, such as, for example plastic, nylon, metal, or the like. Optionally, first pull tab 8 and first pull tab extender 18 can be integrally formed as one piece, and also integrally formed with first slider 6 as one continuous piece. Optionally, second pull tab 12 and second pull tab extender 20 can be integrally formed as one piece, and also integrally formed with second slider 11 as one continuous piece.

To use zipper system 10, a person would thread a finger through rings 27 and 28 of pull tab extenders 18 and 20 and use an upward pulling motion or force to close zipper system 10. The combination of the pull tab extenders coupled with the connector 16 that attaches sliders 2, 6, and 11, allows a user to apply enough force to enable first slider 6 and second slider 11 to advance along teeth 15 of each respective track 13 and 14 while also pulling third slider 2, thereby causing teeth 15 of first track 13 and second track 14 to mate without having to use a second (or even third) hand to apply adequate compressive force to allow the zipper system 10 to close.

Zipper system 10 is typically integrated into a garment 30. In an exemplary embodiment, zipper tape 32 is sewn into garment 30. Zipper tape 32 can be made from any natural or synthetic material or combination of natural and synthetic materials, such as, for example cotton, nylon, polyester, and combinations thereof. Zipper tape 32 further provides bottom stop 36 for zipper system 10 to prevent the sliders 2, 6, and 11 from detaching from the tracks 13, and 14 when the zipper system 10 is fully opened. Garment 30 can be made from any type of synthetic or natural material, such as cotton, polyester, nylon, spandex, or any combinations of natural or synthetic materials. Zipper system 10 works well with garments and material that are elastic in nature and require adequate inward force to allow teeth 15 to mate and form closed chain 34.

As shown in FIG. 1, zipper system 10 may also contain a protective sleeve or sheet of material 50 that prevents the user's skin or hair from getting caught in teeth 15. Protective sheet 50 is usually found at the bottom or starting point of zipper system 10, but protective sheet 50 may run the whole length of zipper system 10. Protective sheet 50 may be sewn into zipper system 10 or formed integrally with zipper system 10.

Figure 2:
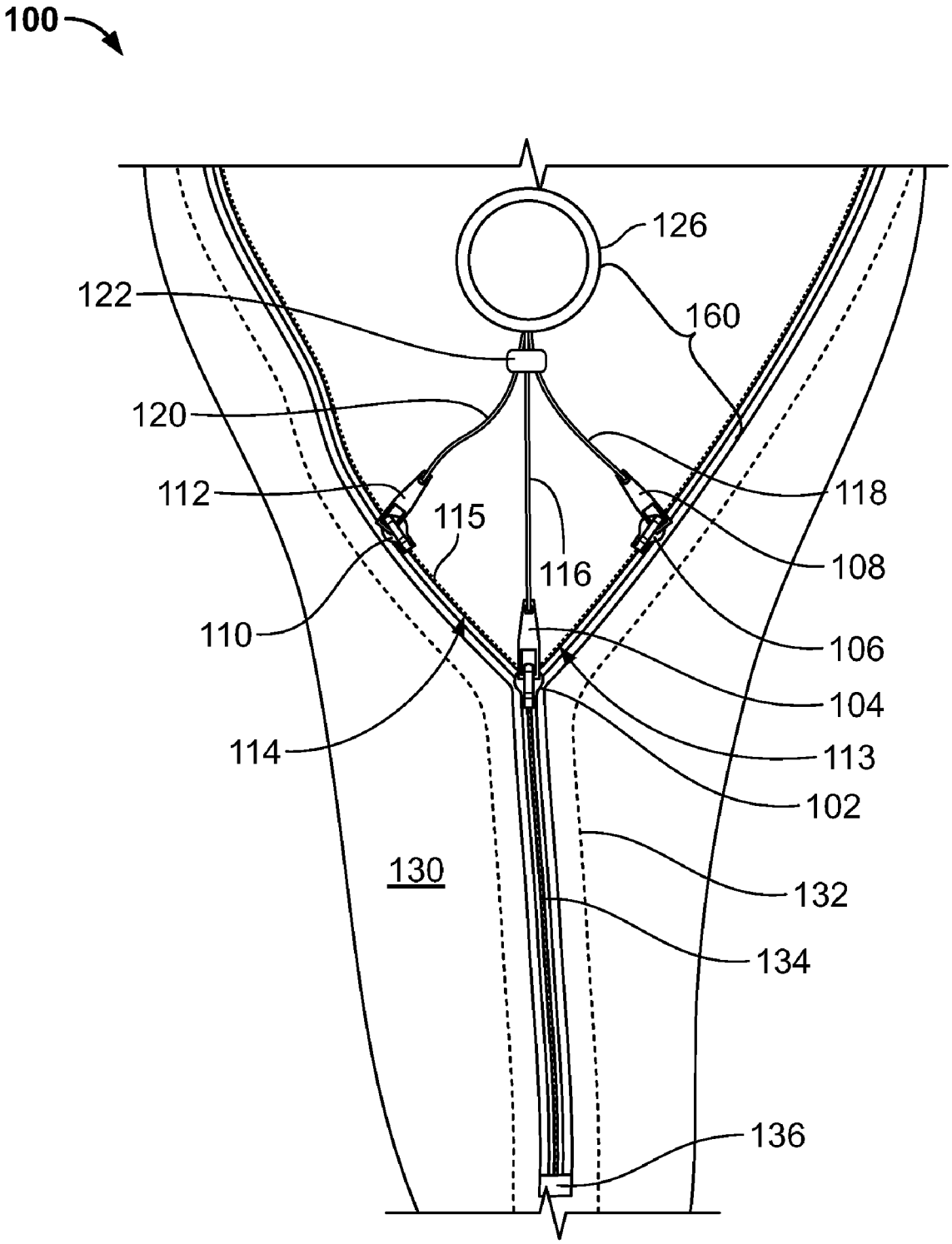
FIG. 2 is a front view of a second exemplary embodiment of the zipper system of the present invention.

FIG. 2 provides a front view of a second exemplary embodiment of zipper system 100 for use with one hand. In this embodiment, zipper system 100 includes first track 113 and second track 114, wherein each track comprises a row of fasteners or teeth 115 that are mate-able with each to form a closed chain 134. Fasteners or teeth 115 of zipper system 100 can be made of any type of material commonly used in the art to make zippers, such as metal, plastic, nylon and combinations thereof. Zipper system 100 further comprises a plurality of sliders, first slider 106, second slider 110, and third slider 102 that cooperate and slide along teeth 115 of zipper system 100. Third slider 102 is located centrally between first and second sliders 106, and 110. First slider 106 slides along teeth 115 of first track 113 and second slider 110 slides along teeth 115 of second track 114 to provide adequate traction and grip for zipper system 100. Third slider 102 cooperates and slides along teeth 115 of both first track 113 and second track 114 and causes teeth 115 of both tracks 113 and 114 to mate to form closed chain 134 of zipper system 100.

Zipper system 100 further comprises a connector system 160 that joins the plurality of sliders 102, 106, and 110 to allow a user to advance the plurality of sliders along teeth 115 of tracks 113,114 using only one hand. Connector system 160 further comprises a plurality of extenders which are further attached to a pull ring 126. The plurality of extenders comprises three different extenders 116, 118, and 120 which are attached to the pull tabs 104, 108, and 112 of the sliders 102, 106, 110. The extenders can be a string, a cord, a chain or the like, and can be made from any suitable durable and tough material known in the art, for example such as metal, plastic, nylon, or the like. First extender 118 is attached to first pull tab 108 of first slider 106 and further attached to pull ring 126. Second extender 120 is attached to second pull tab 112 of second slider 110 and further attached to pull ring 126. Third extender 116 is attached to third pull tab 104 of third slider 102 and further attached to pull ring 126. Pull ring 126 can be made of any material that provides a non-slip grip for the user such as metal coated with a rubber or plastic, a plastic non-slip ring, or a hard rubber ring. The combination of the extension system attached to the pull ring 126 allows a user to apply enough inward compressive force to enable third slider 102 to cause teeth 115 of first track 113 and second track 114 to mate without having to use a second (or even third) hand to apply adequate inward pressure to allow the zipper system 100 to close.

Figure 3A:
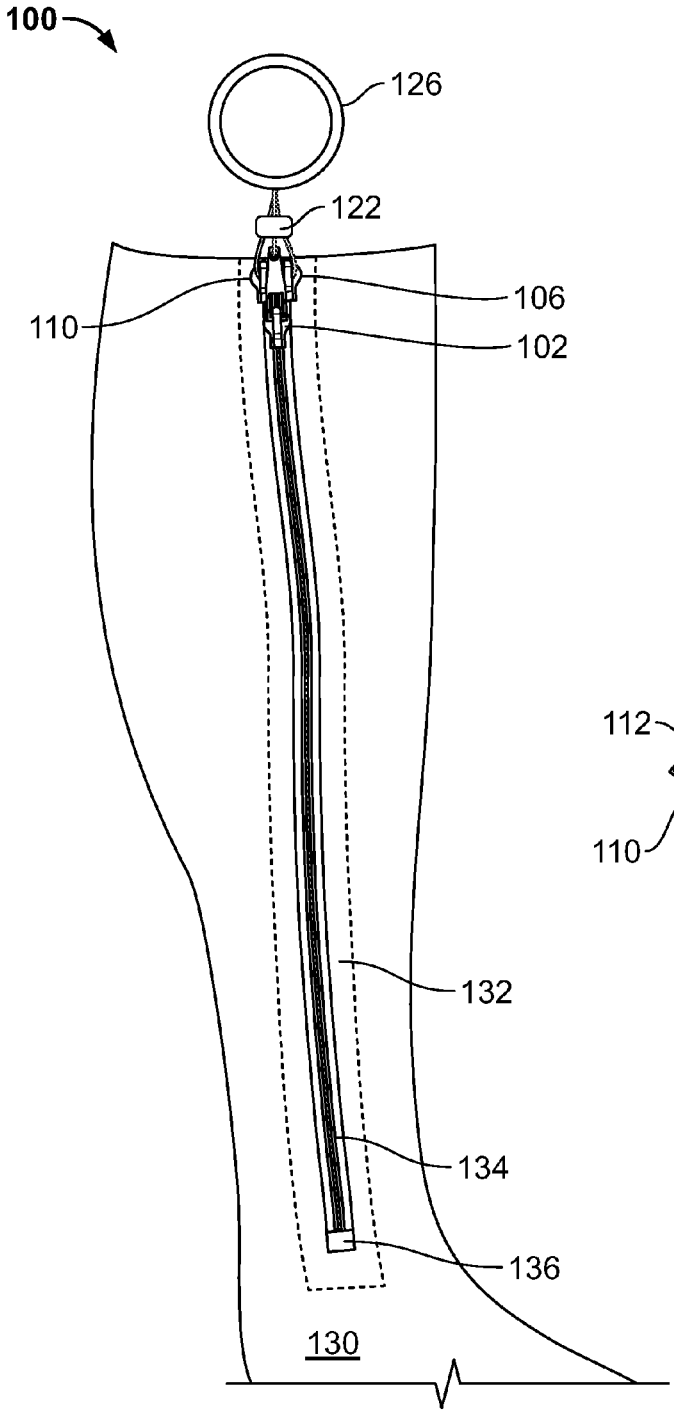
FIG. 3*a* is a front view of the second exemplary embodiment in use in a garment, such as a medical compression stocking, showing a closed zipper with mated teeth.
Figure 3B:
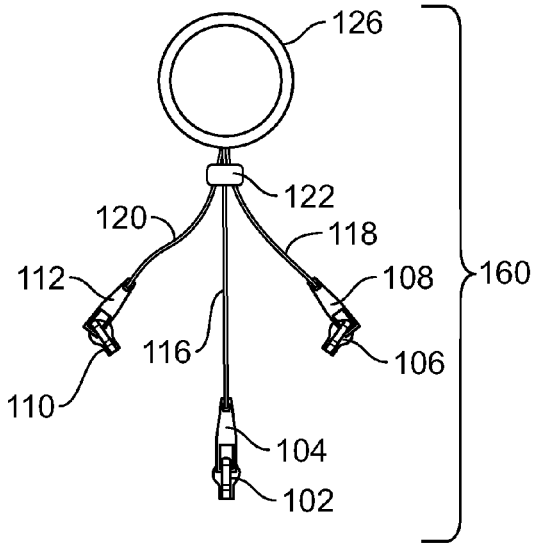
FIG. 3*b* is a close-up view of the connector system of the second exemplary embodiment, of the present invention.

FIG. 3*a* provides a front view of the second exemplary embodiment of zipper system 100 sewn into a garment 130, such as a medical support hose, shown with closed chain 134. Once the sliders 102, 106, and 110 have reached the predetermined position stopper 122, which can be a slip ring, is applied to the zipper system 100 to prevent the sliders 102, 106, and 110 from slipping back down the tracks 113, 114 and causing closed zipper chain 134 to open. When a user wants to remove the garment user just needs to lift up stopper 122 to allow sliders 102, 106, and 110 to travel back down the tracks 113, 114 to open up closed chain 134. FIG. 3*b* is a close-up of connector system 160 of the first embodiment.

As shown in FIG. 1 zipper system 100 is integrally formed within a garment 130. In an exemplary embodiment zipper tape 132 is sewn into garment 130. Zipper tape 132 can be made from any natural or synthetic material or combination of natural and synthetic materials known in the art, such as cotton, nylon, polyester, and combinations thereof. Zipper tape 132 further provides a bottom stop 136 for zipper system 100 to prevent the sliders 102, 106, and 110 from leaving the tracks 113, and 114 when the zipper system 100 is fully opened. Garment 130 can be made from any type of synthetic or natural material, such as cotton, polyester, nylon, spandex, or combinations of any natural or synthetic materials. Zipper system 100 works well with garments and material that are elastic in nature and require adequate inward force to allow teeth 115 to mate and form closed chain 134.

Optionally, this first embodiment can be used without pull ring 126 (not shown in the figures). The plurality of extenders may be free strings, cords, or chains made from a suitable durable and tough material known in the art, for example plastic or nylon. To close zipper system 100 user would grasp the ends of the extenders and use upward force to allow the sliders 106 and 110 to travel up the teeth 115 of the tracks 113 and 114, providing sufficient inward compressive force to enable third slider 102 to travel along the teeth 115 of the tracks 113 and 114, causing the teeth 115 of the tracks 113 and 114 to mate and form closed chain 134 zipper system 100. Once the predetermined position is obtained the extenders 116, 118, and 120 are looped under the third slider 102 and top of garment 130 is rolled over the sliders 102, 106, 110 and extenders 116, 118, and 120 to hold zipper system 100 closed, without having to use a slip ring or stopper 122 to keep zipper system 100 closed.

Figure 4:
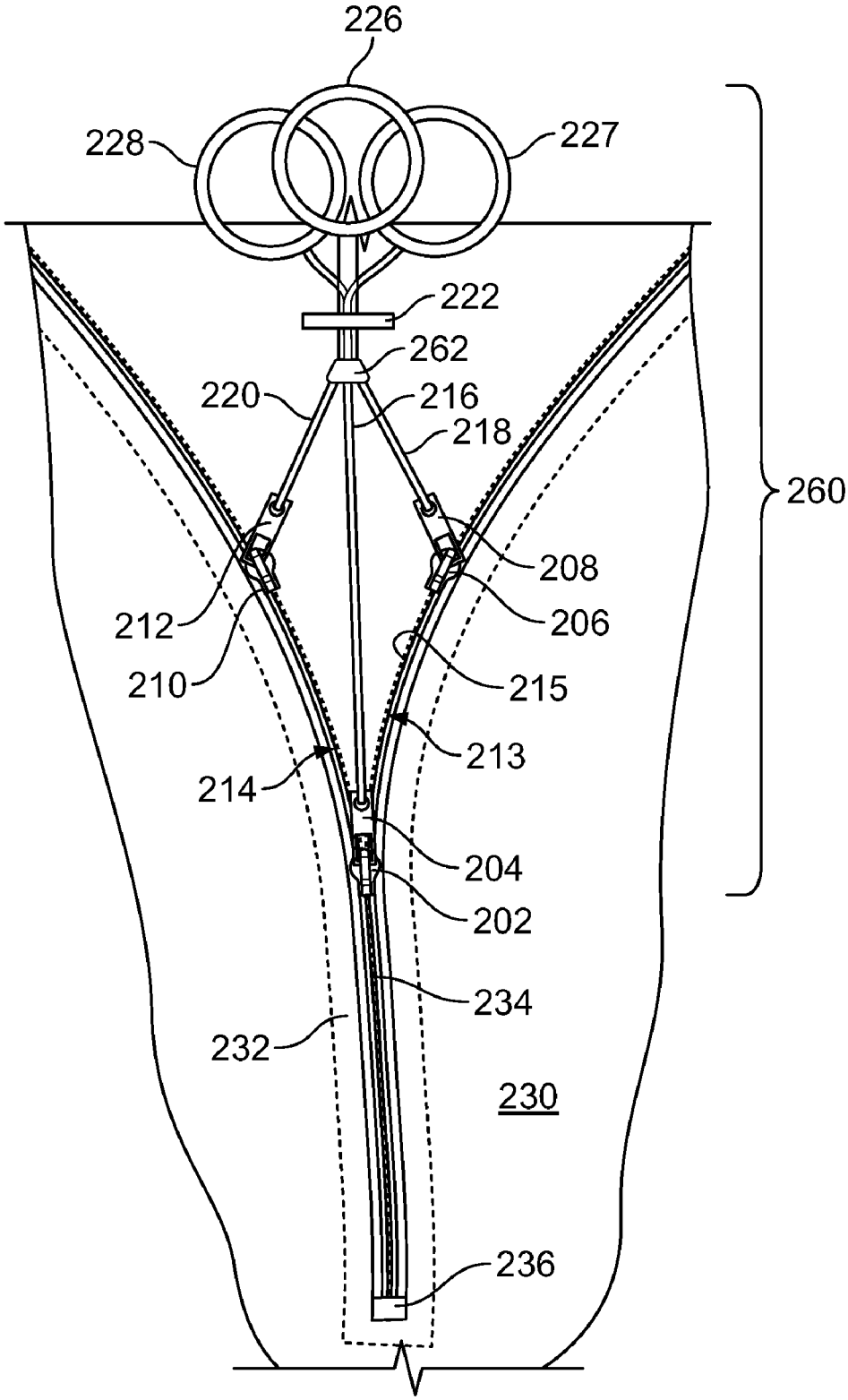
FIG. 4 is a front view of the third exemplary embodiment of the zipper system, of the present invention showing the mated zipper teeth.

FIGS. 4*a-b* illustrate a third exemplary embodiment of zipper system 200. In this embodiment, zipper system 200 includes first track 213 and second track 214, wherein each track comprises a row of fasteners or teeth 215 that are mate-able with each to form a closed chain 234. Fasteners or teeth 215 of zipper system 200 can be made of any type of material commonly used in the art to make zippers, such as metal, plastic, nylon and combinations thereof. Zipper system 200 further comprises a plurality of sliders, first slider 206, second slider 210, and third slider 202, that cooperate and slide along teeth 215 of zipper system 200. Third slider 202 is located centrally between the first and second sliders 206, and 210. First slider 206 slides along teeth 215 of first track 213 and second slider 210 slides along teeth 215 of second track 214, to provide adequate traction and grip for zipper system 200. Third slider 202, cooperates and slides along teeth 215 of both first track 213 and second track 214 and causes teeth 215 of both tracks 213 and 214 to mate to form closed chain 234 of zipper system 200.

Zipper system 200 further comprises a connector system 260 that joins the plurality of sliders 202, 206, and 210 to allow a user to advance the plurality of sliders along teeth 215 of tracks 213, 214, using only one hand. Connector system 260 further comprises a plurality of extenders which are further bundled together and attached to pull rings. The plurality of extenders comprises three different extenders 216, 218, and 220 which are attached to the pull tabs 204, 208, and 212 of the sliders 202, 206, 210, respectively, and bundled together by a bundler 262. The extenders can be string, cord, chain or the like, and can be made from any suitable durable and tough material known in the art, for example such as metal, plastic, nylon, or the like. First extender 218 is attached to first pull tab 208 of first slider 206 and further attached to first pull ring 227. Second extender 220 is attached to second pull tab 212 of second slider 210 and further attached to second pull ring 228. Third extender 216 is attached to third pull tab 204 of third slider 202 and further attached to third pull ring 226. Pull rings 226, 227, and 228 can be made of any material that provides a non-slip grip for the user such as metal coated with a rubber or plastic, a plastic non-slip ring, or a hard rubber ring.

To use zipper system 200, a person would thread a single finger though each of pull rings 226, 227, and 228 and use an upward pulling motion or force to close zipper system 200. The combination of the extension system attached to the plurality of pull rings 226, 227, and 228 bundled together by bundler 262, allows a user to apply enough inward compressive force to enable first slider 206 and second slider 210 to advance up teeth 215 of tracks 213 and 214 which in turn enables third slider 202 to cause teeth 215 of first track 213 and second track 214 to mate without having to use a second (or even third) hand to apply pressure to allow the zipper system 200 to close. Pull rings 226, 227, and 228 can be integrally combined such that third pull ring 226 is joined to both first pull ring 227 and second pull ring 228. To use zipper system 200 a person may stick a finger through only third pull ring 226 and use an upward pulling motion or force to close zipper system 200 or the user may use all three pull rings 226, 227, and 228 to assert sufficient force to close the zipper system 200.

Once the sliders 202, 206, and 210 have reached the desired closed position stopper 222, which can take the form of a slip ring or other device, is applied to the zipper system 200 to prevent the sliders 202, 206, and 210 from slipping back down the tracks 213, 214 and causing closed zipper chain 234 to open. When a user wants to remove the garment that person just needs to release the stopper 222 to allow sliders 202, 206, and 210 to travel back down the tracks 213, 214 to open up closed chain 234. Zipper system 200 works well with garments and material that are elastic in nature.

Zipper system 200 is integrally formed within a garment 230. In an exemplary embodiment zipper tape 232 is sewn into garment 230. Zipper tape 232 can be made from any natural or synthetic material or combination of natural and synthetic materials known in the art, such as cotton, nylon, polyester, and combinations thereof. Zipper tape 232 further provides a bottom stop 236 for zipper system 200 to prevent the sliders 202, 206, and 210 from leaving the tracks 213 and 214 when the zipper system 200 is fully opened. Garment 230 can be made from any type of synthetic or natural material, such as cotton, polyester, nylon, spandex, or any combinations of natural or synthetic materials. Zipper system 200 works well with garments and material that are elastic in nature and require adequate inward force to allow teeth 215 to mate and form closed chain 234.

Figure 5A:
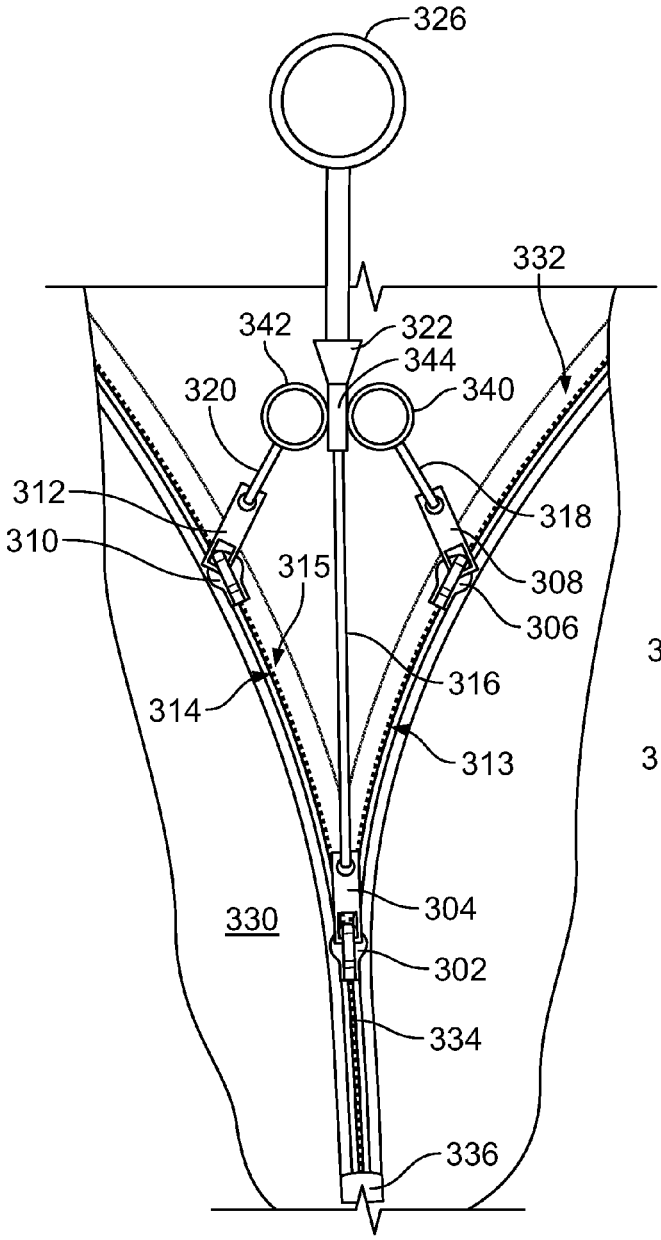
FIGS. 5*a-b* illustrate a fourth exemplary embodiment of the zipper system of the present invention.
Figure 5B:
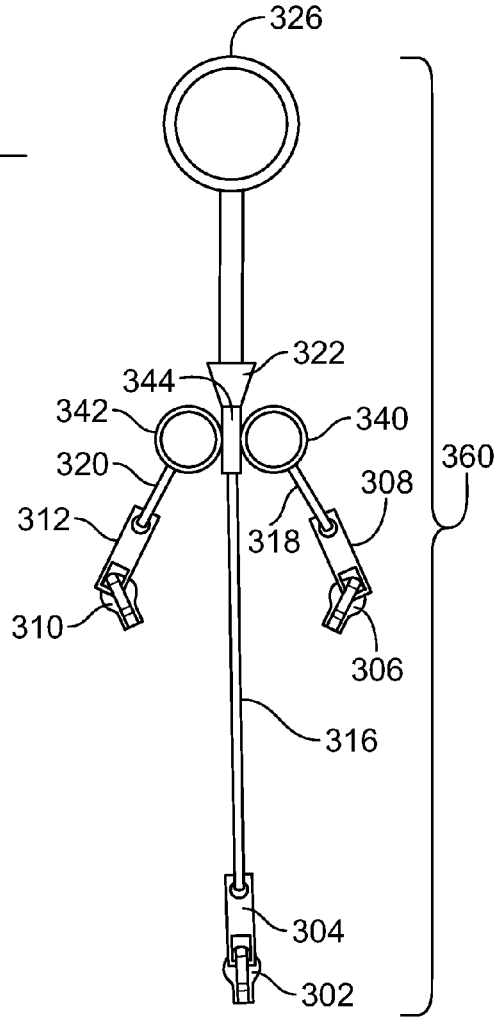
Figure 6:
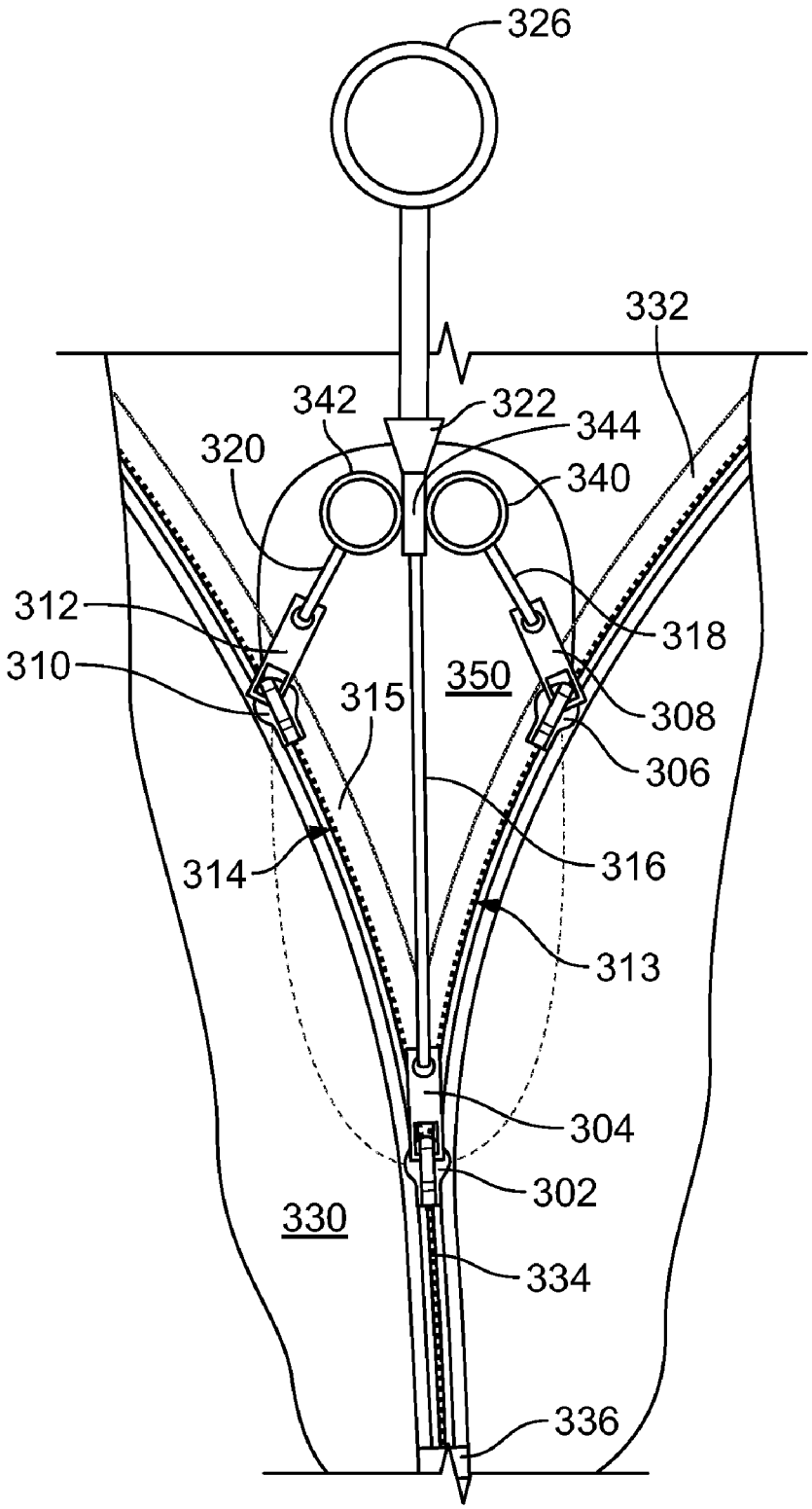
FIG. 6 is a front view of the fourth exemplary embodiment of the zipper system highlighting a protective sleeve.

FIGS. 5-6 illustrate a fourth exemplary embodiment of zipper system 300. FIG. 4*a* provides a front view of a third exemplary embodiment of zipper system 300. Zipper system 300 includes first track 313 and second track 314, wherein each track comprises a row of fasteners or teeth 315 that are mate-able with each other to form a closed chain 334. Fasteners or teeth 315 of zipper system 300 can be made of any type of material commonly used in the art to make zippers, such as metal, plastic, nylon and combinations thereof. Zipper system 300 further comprises a plurality of sliders, first slider 306, second slider 310, and third slider 302, that cooperate and slide along teeth 315 of zipper system 300. Third slider 302 is located centrally between the first and second sliders 306, and 310. First slider 306 slides along teeth 315 of first track 313 and second slider 310 slides along teeth 315 of second track 314 to provide adequate traction and grip for zipper system 300. Third slider 302 cooperates and slides along teeth 315 of both first track 313 and second track 314 and causes teeth 315 of both tracks 313 and 314 to mate to form closed chain 334 of zipper system 300.

Zipper system 300 further comprises a connector system 360 (shown in FIG. 5*b*) that joins the plurality of sliders 302, 306, and 310 to allow a user to advance the plurality of sliders along teeth 315 of tracks 313, 314 using only one hand. Connector system 360 further comprises a plurality of extenders connected to a third connector piece 344 and brake mechanism 322 which is further connected to a pull ring 326. Pull ring 326 can be made of any material that provides a non-slip grip for the user such as metal coated with a rubber or plastic, a plastic non-slip ring, or a hard rubber ring. The plurality of extenders comprises three different extenders 316, 318, and 320 which are attached to the pull tabs 304, 308, and 312 of the sliders 302, 306, 310. First extender 318 is connected to first connector piece 340 which is further connected to third connector piece 344. Second extender 320 is connected to second connector piece 342 which is further connected to third connector piece 344. Third extender 316 is connected to a third connector piece 344. Third connector piece 344 is further connected to brake/release mechanism 322 and brake/release mechanism 322 is further connected to pull ring 326. The plurality of extenders can be string, cord, chain, or the like, and can be made from any suitable durable and tough material known in the art, for example such as plastic, nylon, metal, or the like.

To use zipper system 300 a person would thread a finger through pull ring 326 and use an upward pull motion or force to close zipper system 300. The combination of the extension system attached to pull ring 326 joined together by third connector piece 344, allows a user to apply enough inward compressive force to enable first slider 306 and second slider 310 to advance up teeth 315 of each respective track 313 and 314 which in turn enables third slider 302 to cause teeth 315 of first track 313 and second track 314 to mate without having to use a second (or even third) hand to apply pressure to allow the zipper system 300 to close.

Once the sliders 302, 306, and 310 have reached the predetermined closed position brake/release system 322 is applied to zipper system 300 to prevent sliders 302, 306, and 310 from slipping back down the tracks 313, 314 and causing closed zipper chain 334 to open. Brake/release system 322 also allows a user to easily advance or retract the sliders 320, 306, and 310 of zipper system 300, using one hand. When a user wants to remove the garment that person just needs to release the brake system 322 to allow sliders 302, 306, and 310 to travel back down the tracks 313, 314 to open up closed chain 334 of zipper system 300.

Zipper system 300 is integrally formed within a garment 330. In an exemplary embodiment zipper tape 332 is sewn into garment 330. Zipper tape 332 can be made from any natural or synthetic material or combination of natural and synthetic materials known in the art, such as cotton, nylon, polyester, and combinations thereof. Zipper tape 332 further provides a bottom stop 336 for zipper system 300 to prevent the sliders 302, 306, and 310 from leaving the tracks 313, and 314 when the zipper system 300 is fully opened. Garment 330 can be made from any type of synthetic or natural material, such as cotton, polyester, nylon, spandex, or any combinations of any natural or synthetic materials. Zipper system 300 works well with garments and material that are elastic in nature and require adequate inward force to allow teeth 315 to mate and form closed chain 334.

As shown in FIG. 6 zipper system 300 may also contain a protective sleeve or sheet of material 350 that prevents the user's skin or hair from getting caught in teeth 315 of zipper system 300. Protective sheet 350 is usually found at the bottom or starting point of zipper system 300, but protective sheet 350 may run the whole length of zipper system 300 if necessary. Protective sheet may be sewn into zipper system 300 or integrally formed within zipper system 300.

Figure 7:
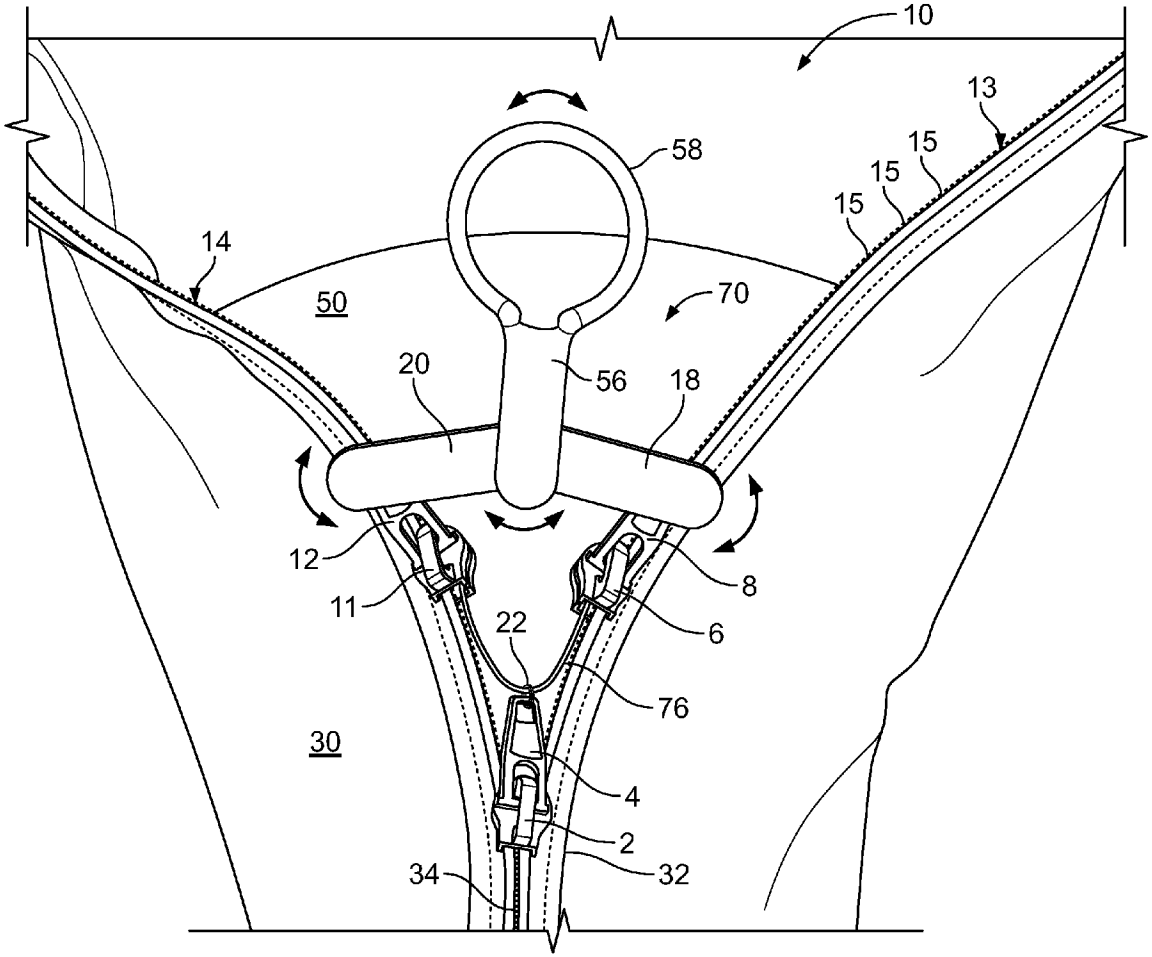
FIGS. 7 and 8 are front views of a fifth exemplary embodiment of the zipper system of the present invention.
Figure 8:
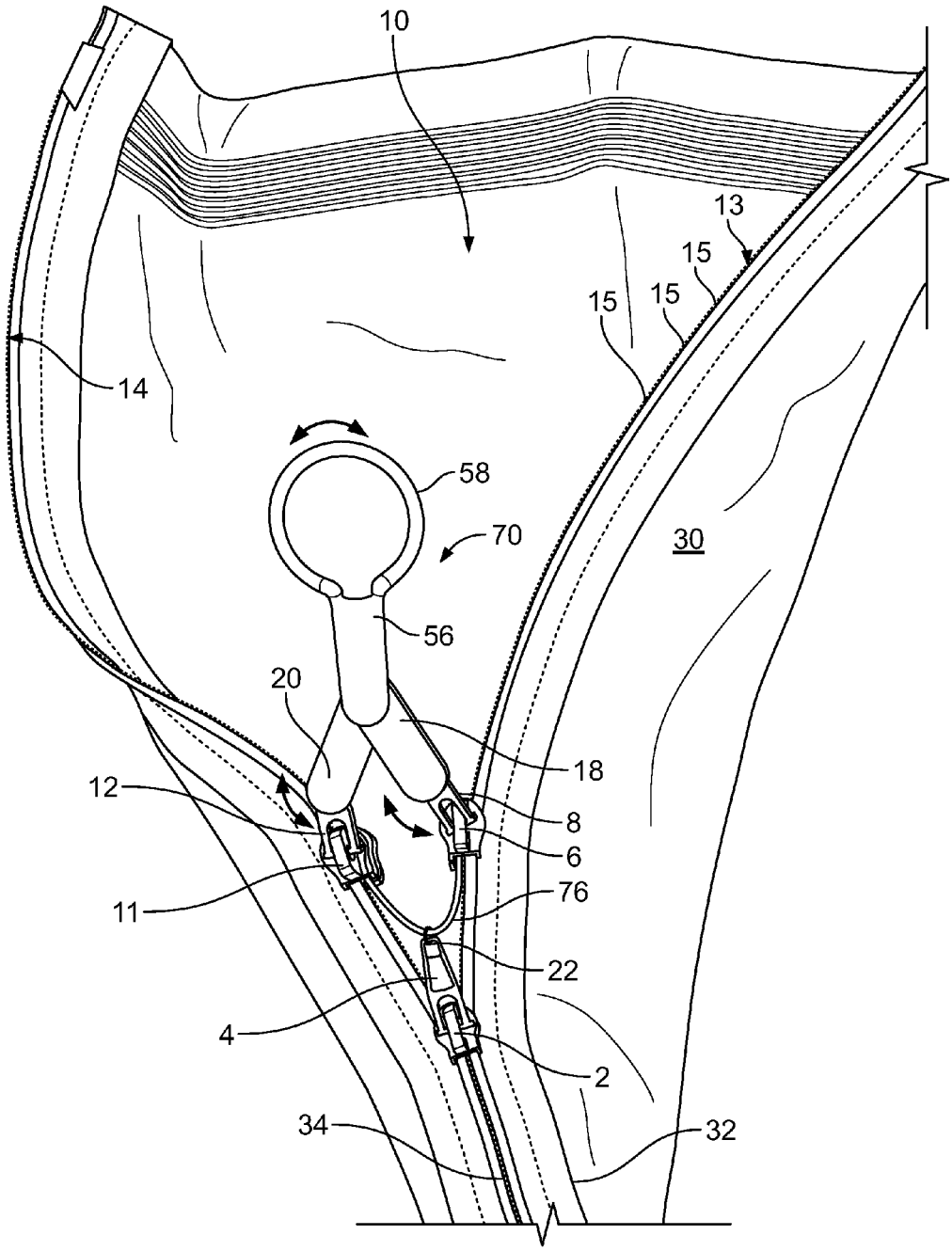

FIGS. 7-11 illustrate a fifth exemplary embodiment of zipper system 10 adapted for use with one hand. Zipper system 10 includes first track 13 and second track 14, a plurality of sliders, a connector system 70, and a connector 76 attached to third pull tab 4 of third slider 2. As shown in FIGS. 7 and 8, zipper system 10 includes first track 13 and second track 14, wherein each track comprises a row of fasteners or teeth 15 that are adapted to mate or that are mate-able with each other to form a closed chain 34. Fasteners/teeth 15 of zipper system 10 can be made of any type of material commonly used to make zippers, such as metal, plastic, nylon and combinations thereof. Zipper system 10 further comprises a plurality of sliders: first slider 6, second slider 11, and third slider 2, that are adapted to move along the tracks of zipper system 10. First slider 6 is adapted to slide along first track 13 and second slider 11 is adapted to slide along second track 14. Third slider 2, central to first slider 6 and second slider 11, cooperates with both first track 13 and second track 14 to cause first track 13 and second track 14 to mate to form closed chain 34. First slider 6 further includes a first pull tab 8 connected thereto and second slider 11 further includes a second pull tab 12 connected thereto.

Connector system 70 includes a plurality of extenders, first extender 18 and second extender 20, and a joining device 56. First extender 18 includes a retaining portion and a closing portion. The retaining portion of first extender 18 further includes a front side, which is shown in FIGS. 7 and 8, and a back side which is not shown in the Figures. First pull tab 8 of first slider 6 is pivotally connected to a first extender 18 by a first pin assembly 52 (see FIG. 9). First pin assembly 52 allows first extender 18 to pivot and move within first pull tab 8, as shown by the arrows. First pin assembly 52 is integrally formed with the back side of the retaining portion of first extender 18. First pin assembly 52 receives the aperture in first pull tab 8 and closing portion of first extender 18 covers pin assembly 52 to secure first extender 18 in place on first pull tab 8.

Second extender 20 includes a retaining portion and a closing portion. The retaining portion of second extender 20 further includes a front side, which is shown in FIGS. 7 and 8, and a back side which is not shown in the Figures. Second pull tab 12 of second slider 11 is pivotally connected to second extender 20 by a second pin assembly 53 (see FIG. 9). Second pin assembly 53 allows second extender 20 to pivot and move within second pull tab 12, as shown by the arrows. Second pin assembly 53 is integrally formed with the back side of the retaining portion of second extender 20. Second pin assembly 53 receives the aperture in second pull tab 12 and closing portion of second extender 20 covers second pin assembly 53 to secure second extender 20 in place on second pull tab 12.

Figure 9:
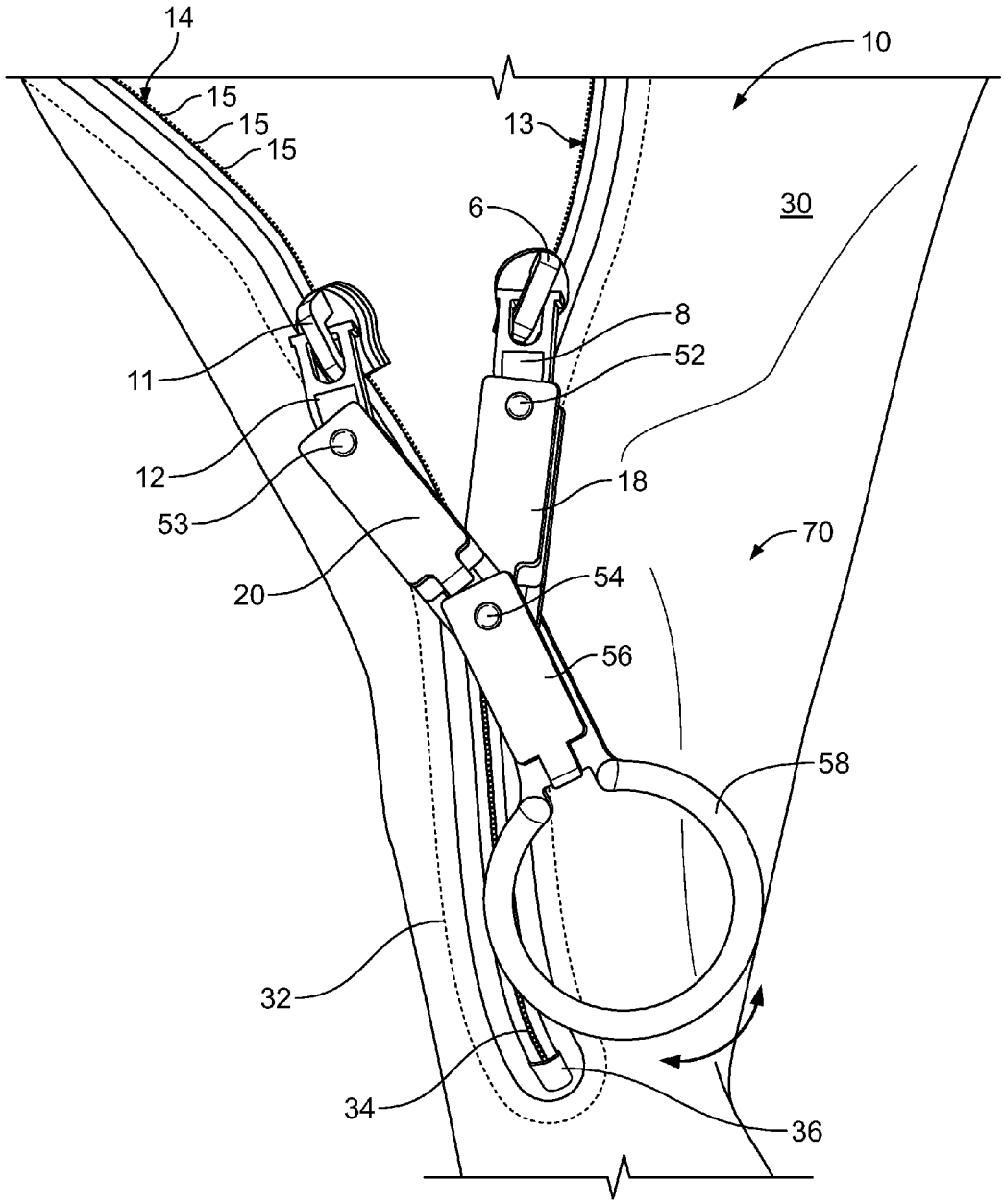
FIG. 9 is a back view of the connector system of the fifth exemplary embodiment of the zipper system of the present invention.

Joining device 56 is pivotally connected to and joins first extender 18 to second extender 20 by a third pin assembly 54 (see FIG. 9). Joining device 56 includes a retaining portion and a closing portion. The retaining portion of joining device 56 further includes a front side, which is shown in FIGS. 7 and 8, and a back side which is not shown in the Figures. Third pin assembly 54 allows joining device to move as shown by the arrows in FIG. 7. Third pin assembly 54 is integrally formed with the back side of the retaining portion of the joining device 56. Retaining portion which includes third pin assembly 54 receives apertures (not shown) in first extender 18 and second extender 20, to pivotally connect all three portion of connector system 70. Closing portion of joining device 56 is used to hold first extender 18 and second extender 20 in place on third pin assembly 54.

Pin assemblies 52, 53, and 54 allow connector system 70 to expand, as shown in FIG. 7 and contract, as shown in FIG. 8. As shown by the arrows in the Figures, pin assemblies 52, 53, and 54 act as pivots and 54 allow a user of the zipper system 10 to move the whole connector system 70 to the left or right to obtain better compressive force between first track 13 and second track 14 to allow the teeth 15 of tracks to mate to form closed zipper 34.

Third slider 2 cooperates and moves or slides along teeth 15 of both first track 13 and second track 14 and causes teeth 15 of both tracks 13 and 14 to mate to form closed chain 34. Zipper system 10 further comprises a connector 76 that joins the plurality of sliders 2, 6, and 11 to allow a user to advance the plurality of sliders along teeth 15 of tracks 13, 14 using only one hand. As shown in FIG. 7, connector 76 operates to link third slider 2 with first and second sliders 6 and 11. In the present embodiment, connector 76 runs through joining ring 22, which attaches connector 76 to third pull tab 4 of third slider 2. In an alternative embodiment, joining ring 22 is not present and the connector 76 is run directly through third pull tab 4 of third slider 2.

Extenders 18 and 20 of connector system 70 can be made from any material that will allow upward force to be applied by the user. Extenders 18 and 20 can be made from any suitable durable material known, such as, for example, plastic, nylon, metal, high strength light weight alloys, combinations thereof, or the like. Examples of high strength light weight alloys are but not limited to aluminum alloys and titanium alloys. Joining device 56 is made from any material that will allow upward force to be applied by the user. Joining device 56 can be made from any suitable durable material known, such as, for example, plastic, nylon, metal, high strength light weight alloys, combinations thereof, or the like.

To use zipper system 10, a person threads at least one finger through ring portion 58 of joining device 56 and uses an upward pulling motion or force to close zipper system 10. Extenders 18, 20 coupled with the joining device 56 and connector 76 that attaches sliders 2, 6, and 11, allows a user to apply enough force to enable first slider 6 and second slider 11 to advance along teeth 15 of each respective track 13 and 14. While first slider 6 and second slider 11 advance along teeth of each respective track 13 and 14 third slider 2 is pulled, thereby causing teeth 15 of first track 13 and second track 14 to mate without having to use a second (or even third) hand to apply adequate compressive force to close the zipper system 10. Pin assemblies 52, 52, and 54 allow user of zipper system 70 to obtain compression force in any direction that is most convenient for the user.

Zipper system 10 is typically integrated into a garment 30. In an exemplary embodiment, zipper tape 32 is sewn into garment 30. Zipper tape 32 can be made from any natural or synthetic material or combination of natural and synthetic materials, such as, for example cotton, nylon, polyester, and combinations thereof. Zipper tape 32 further provides bottom stop 36 for zipper system 10 to prevent the sliders 2, 6, and 11 from detaching from the tracks 13, and 14 when the zipper system 10 is fully opened. Garment 30 can be made from any type of synthetic or natural material, such as cotton, polyester, nylon, spandex, or any combinations of natural or synthetic materials. Zipper system 10 works well with garments and material that are elastic in nature and require adequate inward force to allow teeth 15 to mate and form closed chain 34.

As shown in FIG. 7, zipper system 10 may also contain a protective sleeve or sheet of material 50 that prevents the user's skin or hair from getting caught in teeth 15. Protective sleeve 50 is usually found at the bottom or starting point of zipper system 10, but protective sleeve 50 may run the whole length of zipper system 10. Protective sleeve 50 may be sewn into zipper system 10 or formed integrally with zipper system 10.

Figure 10:
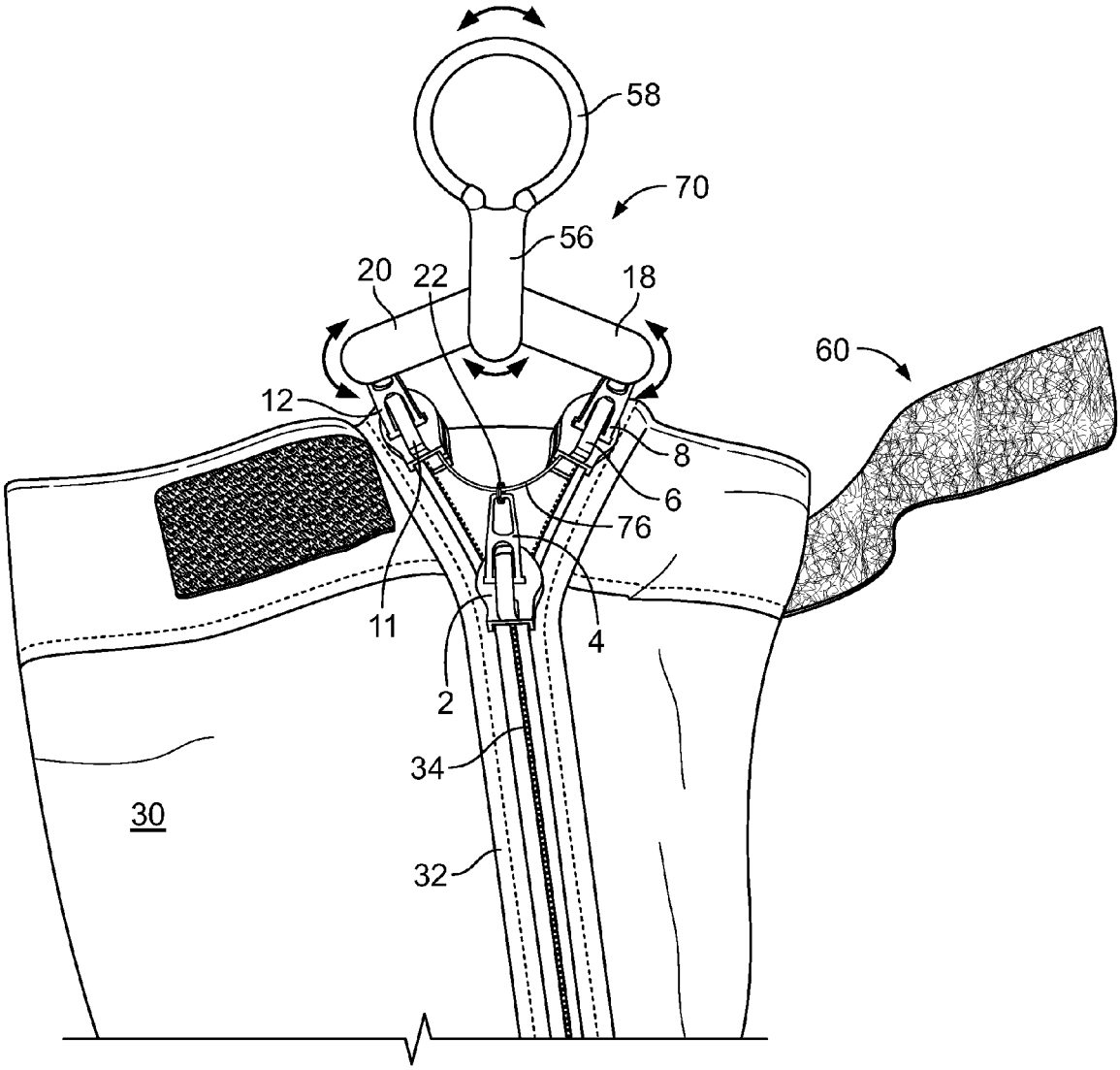
FIGS. 10 and 11 are front views of the stopping member of the fifth exemplary embodiment of the zipper system of the present invention.
Figure 11:
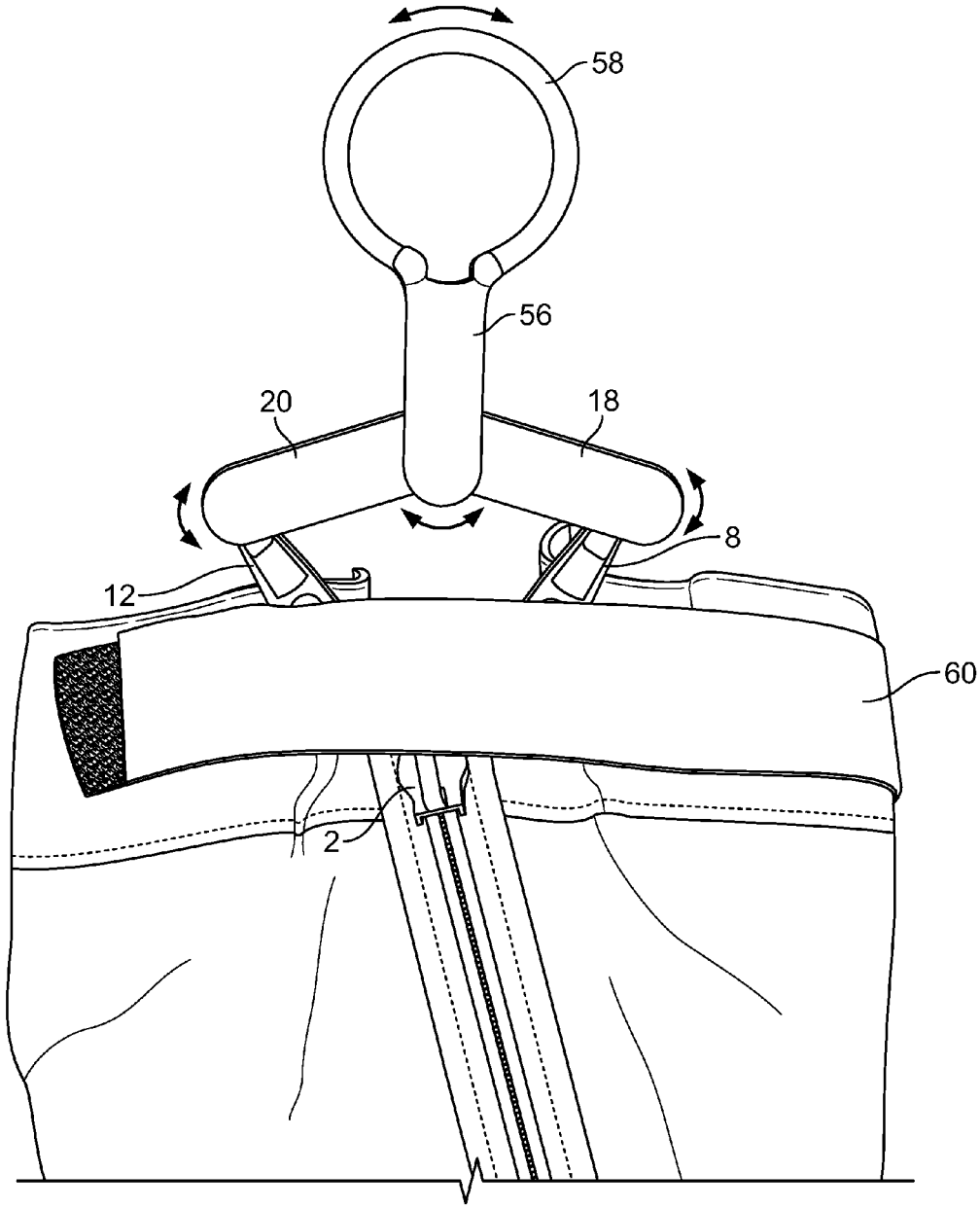

As shown in FIGS. 10 and 11, once the sliders 2, 6, and 11 have reached a predetermined position, stopping member 60 is applied to the zipper system 10 to prevent the sliders 2, 6, and 11 from slipping back down the tracks 13, 14 and causing closed zipper chain 34 to open. When a user wants to remove the garment 30 the user just needs to disengage stopping member 60 to allow sliders 2, 6, and 11 to freely travel back down the tracks 13, 14 to open up closed chain 34. As shown in FIGS. 10 and 11, stopping member 60 can be Velcro; however, in other embodiments, not shown in the Figures stopping member can be any device that prevents sliders 2, 6, and 11 from traveling back down tracks 13, 14. Stopping member 60 prevents reverse movement of the zipper system 10 and can be, for example, but not limited to, hooks, snaps, pin, combinations thereof, and the like.

Figure 12:
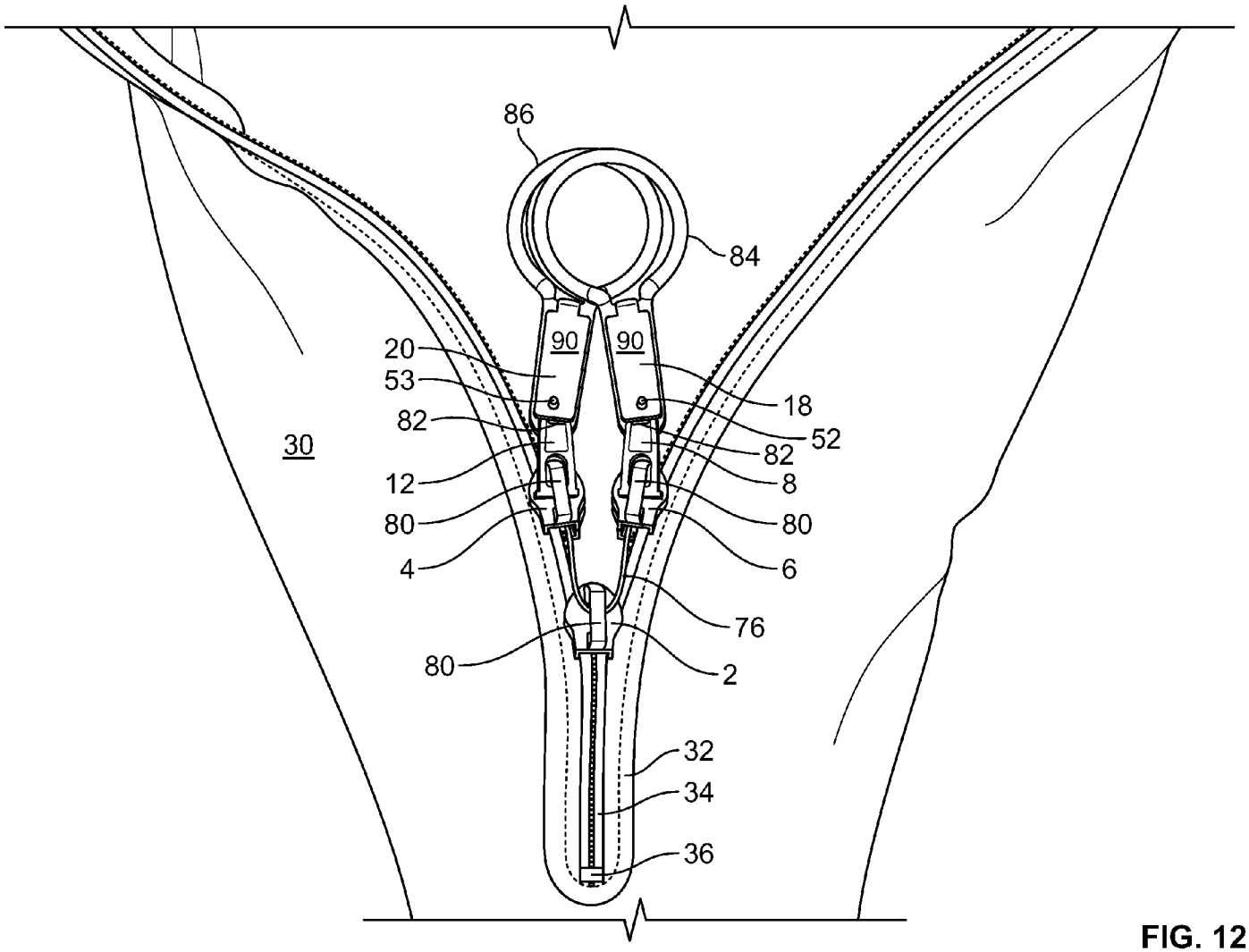
FIG. 12 is a front view of sixth exemplary embodiment of the zipper system of the present invention.
Figure 13A:
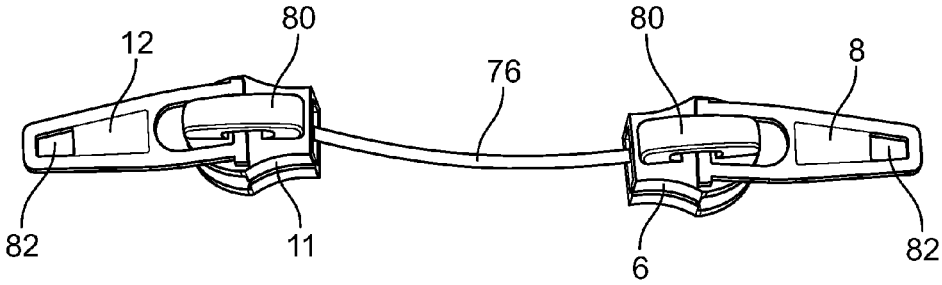
FIG. 13*a* is perspective view of the connector and first and second sliders of the zipper system of the present invention.
Figure 13B:
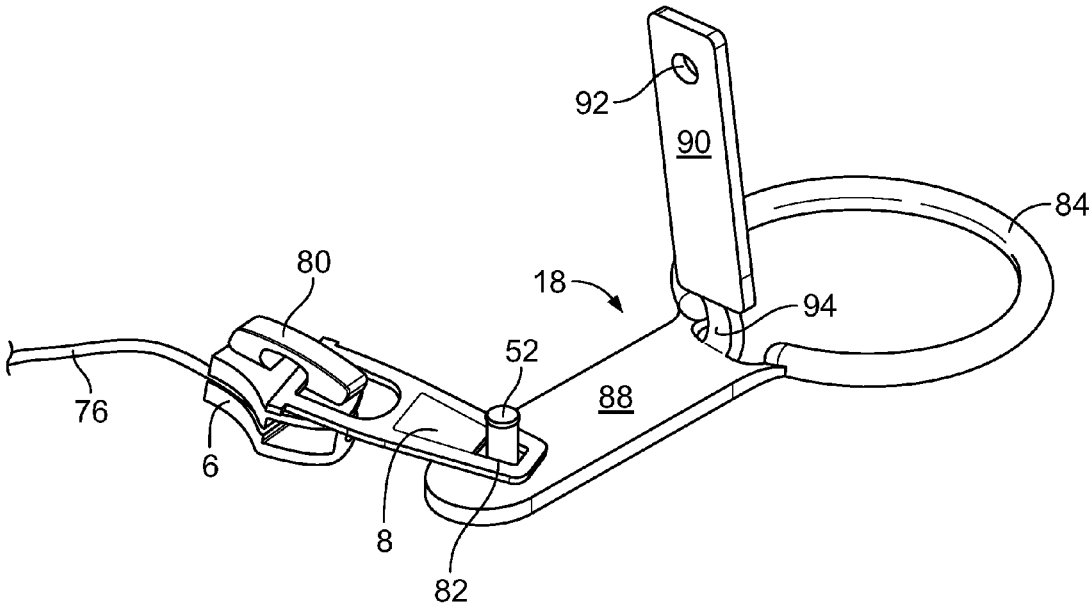
FIG. 13*b* is a perspective view of an extender of the sixth exemplary embodiment of the zipper system of the present invention.

FIGS. 12 and 13*a*-*b* illustrate a sixth exemplary embodiment of zipper system 10 adapted for use with one hand. Zipper system 10 includes first track 13 and second track 14, a plurality of sliders, a connector system 70, and a connector 76 attached to slider cap 80 of third slider 2. As shown in FIG. 12, zipper system 10 includes first track 13 and second track 14, wherein each track comprises a row of fasteners or teeth 15 that are adapted to mate or that are mate-able with each other to form a closed chain 34. Fasteners/teeth 15 of zipper system 10 can be made of any type of material commonly used to make zippers, such as metal, plastic, nylon and combinations thereof. Zipper system 10 further comprises a plurality of sliders: first slider 6, second slider 11, and third slider 2, that are adapted to move along the tracks of zipper system 10. First slider 6 is adapted to slide along first track 13 and second slider 11 is adapted to slide along second track 14. Third slider 2, central to first slider 6 and second slider 11, cooperates with both first track 13 and second track 14 to cause first track 13 and second track 14 to mate to form closed chain 34. First slider 6 further includes a slider cap 80 having a first pull tab 8 connected thereto and second slider 11 further includes a slider cap 80 having a second pull tab 12 connected thereto. Third slider 2 further includes a slider cap 80.

Connector system 70 includes a plurality of extenders, first extender 18 and second extender 20. Each extender includes a retaining portion 88, a closing portion 90, and a ring portion 84, as shown in FIG. 13*b*. Retaining portion 88 of further includes a front side and a back side. Retaining portion 88 and closing portion 90 of extenders 18 and 20 further include a hinge 94 to allow for opening and closing and to secure the pull tab to extenders. Closing portion 90 further includes an aperture 92 to receive top of pin assembly. As shown in FIG. 13*b*, first pull tab 8 of first slider 6 is pivotally connected to a first extender 18 by a first pin assembly 52. First pin assembly 52 allows first extender 18 to pivot and move within first pull tab 8. First pin assembly 52 is integrally formed with the back side of the retaining portion 88 of first extender 18. First pin assembly includes a shaft integrally formed with back side of retaining portion 88 of first extender 18 and a top portion that is slightly larger than shaft to receive aperture of closing portion 90 of extender. First pin assembly 52 receives aperture 82 of first pull tab 8 and closing portion 90 of first extender 18 covers pin assembly 52 to secure first extender 18 in place on first pull tab 8. Although not specifically shown in great detail, second extender 20 and second pin assembly 53 include a retaining portion 88, a closing portion 90, and a ring portion 86, and function in the same manner as described above. In an alternative embodiment, ring portions 84 and 86 of extenders 18 and 20 are connected by another ring or other connecting device.

Third slider 2 cooperates and moves or slides along teeth 15 of both first track 13 and second track 14 and causes teeth 15 of both tracks 13 and 14 to mate to form closed chain 34. Zipper system 10 further comprises a connector 76 that joins the plurality of sliders 2, 6, and 11 to allow a user to advance the plurality of sliders along teeth 15 of tracks 13, 14 using only one hand. As shown in FIG. 13 *a*, connector 76 is attached to first slider 6 and second slider 11 using any suitable means such as, but not limited to, solder, glue, epoxy, or other affixing means. Connector 76 is then attached to third slider 2, through the slider cap 80. In an alternative embodiment, not shown, an additional ring may be used in slider cap 80 and connector 76 may be run through the additional ring to connect the three sliders.

Pin assemblies 52, 53 act as pivots and allow a user of the zipper system 10 to move the whole connector system 70 to the left or right to obtain better compressive force between first track 13 and second track 14 to allow the teeth 15 of tracks to mate to form closed zipper 34.

The sixth exemplary embodiment may also include a stopping member, as shown in FIGS. 10 and 11. Additionally, this embodiment may also include a protective sleeve as shown in FIG. 7.

To use zipper system 10, a person threads at least one finger through ring portion 58 of joining device 56 and uses an upward pulling motion or force to close zipper system 10. Extenders 18, 20 coupled with the joining device 56 and connector 76 that attaches sliders 2, 6, and 11, allows a user to apply enough force to enable first slider 6 and second slider 11 to advance along teeth 15 of each respective track 13 and 14. While first slider 6 and second slider 11 advance along teeth of each respective track 13 and 14 third slider 2 is pulled, thereby causing teeth 15 of first track 13 and second track 14 to mate without having to use a second (or even third) hand to apply adequate compressive force to close the zipper system 10. Pin assemblies 52, 52, and 54 allow user of zipper system 70 to obtain compression force in any direction that is most convenient for the user.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A zipper system adapted for use with one hand, comprising:

(a) a first track and a second track, each track further including a row of teeth, wherein the teeth of the first track are adapted to mate with the teeth of the second track;

(b) a plurality of sliders adapted to cooperate with the row of teeth of the first and the second tracks, wherein the plurality of sliders further includes:

(i) a first slider that is adapted to slide along the first track, (ii) a second slider that is adapted to slide along the second track, and (iii) a third slider, central to the first and second sliders, that cooperates with both the first and second tracks to cause the first track and the second track to mate to form a chain;

(c) a connector system, wherein the connector system further comprises:

(i) a plurality of extenders, wherein the plurality of extenders further includes:

a) a first extender pivotally attached to a first pull tab of the first slider, and b) a second extender pivotally attached to a second pull tab of the second slider, and (ii) a joining device adapted to pivotally connect the first extender with the second extender, wherein the joining device further includes a ring portion; and (d) a connector attached to a third pull tab of the third slider, wherein the connector is operative to link the third slider with the first and second sliders.

2. The zipper system of claim 1, wherein the third pull tab of the third slider further includes a joining ring attached thereto, wherein the joining ring receives the connector and attaches the connector with the third pull tab of the third slider.

3. The zipper system of claim 1 wherein the plurality of extenders and joining device are plastic, nylon, metal, and a combination thereof.

4. The zipper system of claim 1, wherein the zipper system is integrally embedded in a garment.

5. The zipper system of claim 1, wherein the zipper system further includes a stopping member to lock the zipper system in place.

6. The zipper system of claim 1, wherein the each of the plurality of extenders and joining device further include a pin assembly integrally formed on the surface thereof.

7. A zipper system adapted for use with one hand, comprising:

(a) a first track and a second track, each track further including a row of teeth, wherein the teeth of the first track are adapted to mate with the teeth of the second track;

(b) a plurality of sliders adapted to cooperate with the row of teeth of the first and the second tracks, wherein the plurality of sliders further includes:

(i) a first slider that is adapted to slide along the first track, (ii) a second slider that is adapted to slide along the second track, and (iii) a third slider, central to the first and second sliders, that cooperates with both the first and second tracks to cause the first track and the second track to mate to form a chain;

(c) a connector system, wherein the connector system further comprises:

(i) a plurality of extenders, wherein the plurality of extenders further includes:

a) a first extender pivotally attached to a first pull tab of the first slider, and b) a second extender pivotally attached to a second pull tab of the second slider, and (d) a connector attached to a slider cap of the third slider, wherein the connector is operative to link the third slider with the first and second sliders.

8. The zipper system of claim 7, wherein each of the plurality of extenders further includes a pin assembly integrally formed on the surface thereof.

9. The zipper system of claim 7, wherein each of the plurality of extenders further includes a ring portion.

10. The zipper system of claim 7, wherein the zipper system further includes a stopping member to lock the zipper system in place.

11. The zipper system of claim 7, wherein the plurality of extenders and joining device are plastic, nylon, metal, high strength alloys, and a combination thereof.

* * * * *